US007611447B2

(12) United States Patent
Sarma

(10) Patent No.: US 7,611,447 B2
(45) Date of Patent: Nov. 3, 2009

(54) LEG EXERCISE DEVICE

(76) Inventor: Vimala Sarma, C/-PO Box 51, Frenchs Forest, NSW (AU) 2086

( * ) Notice: Subject to any disclaimer, the term of this patent is extended or adjusted under 35 U.S.C. 154(b) by 56 days.

(21) Appl. No.: 10/516,509

(22) PCT Filed: Jun. 3, 2003

(86) PCT No.: PCT/AU03/00698

§ 371 (c)(1),
(2), (4) Date: Dec. 1, 2004

(87) PCT Pub. No.: WO03/101544

PCT Pub. Date: Dec. 11, 2003

(65) Prior Publication Data

US 2006/0154789 A1 Jul. 13, 2006

(30) Foreign Application Priority Data

Jun. 3, 2002 (AU) ..... PS2701

(51) Int. Cl.
*A63B 22/04* (2006.01)
*A63B 21/008* (2006.01)

(52) U.S. Cl. ..... 482/53; 482/112

(58) Field of Classification Search ..... 482/51–53, 482/111–113, 78–79
See application file for complete search history.

(56) References Cited

U.S. PATENT DOCUMENTS 3,987,506 A * 10/1976 Markwitz ..... 601/149
4,146,222 A * 3/1979 Hribar ..... 482/51
5,468,217 A 11/1995 Garcia
5,575,762 A 11/1996 Peeler
5,669,872 A 9/1997 Fox
5,674,262 A 10/1997 Tumey
6,002,965 A 12/1999 Katz
6,045,489 A * 4/2000 Levine et al. ..... 482/53
6,282,448 B1 8/2001 Katz
6,290,662 B1 9/2001 Colestock
6,371,894 B1 4/2002 Hill

FOREIGN PATENT DOCUMENTS

GB 2376415 A * 12/2002
WO WO 9805383 2/1998
WO WO 9809687 3/1998
WO WO 9953996 10/1999

(Continued)

OTHER PUBLICATIONS http://www.veinguard.com/veinguardcushion.html accessed Sep. 25, 2002. Anti DVT cushion.

(Continued)

*Primary Examiner*—Fenn C Mathew

(57) ABSTRACT

A foot and/or leg-exercising device (10) has a first sealed chamber (14) and a second sealed chamber (16) that are interconnected via one or more passageways (34). The chambers (14, 16) are of variable volume and fluid within one chamber may be pumped to the other chamber using the feet and/or legs. In one embodiment each foot is provided with a first chamber and a second chamber and fluid is pumped by a heel and toe rocking action of each foot. The chambers for both feet may be interconnected to allow pumping by an up and down action of the legs.

19 Claims, 10 Drawing Sheets

FOREIGN PATENT DOCUMENTS

| | | |
|---|---|---|
| WO | WO 0147464 | 7/2001 |
| WO | WO 02060724 | 8/2002 |

OTHER PUBLICATIONS http://www.dvtcushions.com/exercises.html & http://www.dvtcushions.com/the%2Ocushion.html accessed Jun. 27, 2002.

http://www.justsellit.co.uk/clients/airogym—various subpages accessed Apr. 9, 2002.

http://www.ebme.co.uk/arts/scd.htm article on pneumatic compression devices—unknown publication date or access date.

* cited by examiner

LEG EXERCISE DEVICE

TECHNICAL FIELD

This invention relates to a leg exerciser and more particularly to a device that allows exercise of the lower legs when sitting or lying.

BACKGROUND ART

When sitting or lying relatively still for long periods of time pooling of fluids occurs in the lower legs. This results in an increased risk of deep vein thrombosis (DVT) occurring in the lower legs or pulmonary embolisms. Although DVT has become well known due to a higher incidence occurring with long haul air travel, sitting still for long periods, such as in trains, buses or wheelchairs or lying, such as in a hospital bed, is also believed to result in DVT in some people. Leg and/or foot exercise whilst sitting or lying is believed to reduce the risk of DVT occurring. Exercising the feet and legs is also recommended for rehabilitation after hospitalisation or immobilisation for any reason, including after operative procedures, injure, stoke, etc. for example, when a person has been injured and has been relatively immobile for some time, wasting of muscles occurs. Providing a device that allows a person to exercise their lower legs whilst lying or sitting also provides therapeutic effects and allows the person to reduce or prevent muscle wasting or to rebuild muscle that has wasted in their lower legs. The invention provides a device to enable a sitting or lying person to exercise their lower legs and/or feet.

DISCLOSURE OF THE INVENTION

In one broad form the invention provides a device having a relatively rigid base and at least one first variable volume chamber mounted on or partially defined by the base, at least one second variable volume chamber mounted on or partially defined by the base and one or more passageways interconnecting the at least one first chamber with the at least one second chamber and a volume of fluid less than the combined maxi mum volume of the first and second chambers being located in at least one of the at least one first and second chambers.

The base is preferably adapted to be attached to another object, so that it may be used as a footrest. The base may include integral mountings or may be produced so that different mountings may be attached to itself.

The first and second chambers may be defined at least partially by a flexible wall or membrane. The chambers may be defined with a movable piston member sliding in a cylinder. When a flexible wall membrane is used, it may be formed of an elastic material or a substantially inelastic material.

Where part of a chamber wall is flexible, the volume of one chamber may be reduced by pressing directly on the flexible wall. The volume may also be reduced indirectly by pressing on a pressure plate or the like that in turn, directly or indirectly, presses on the flexible wall or otherwise reduces the volume of the chamber.

Where the user pushes directly on the chamber walls, the chambers are preferably sized and positioned so that one or both of the user's feet each rest on one or both of the first and second chambers. Using each leg or foot alternately pumps fluid between the first and second chambers.

One preferred embodiment has one first chamber and one second chamber for each foot but multiple first chambers and/or multiple second chambers for each foot are within the scope of the invention.

In another embodiment the at least one first chamber is provided for one foot and the at least one second chamber is provided for the other foot.

In one preferred form the device includes at least one flexible membrane attached to the base. The base and the at least one flexible membrane define at least one first chamber or at least one second chamber or both at least one first chamber and at least one second chamber.

In one embodiment there is a single flexible membrane mounted on each base and it and the respective base define one first chamber and one second chamber.

Preferably the base has a recess for each chamber. However, the base may have a non-recessed surface on which the flexible membrane is mounted. The space between the surface and the flexible membrane defines the chamber.

In one embodiment the flexible membrane is preferably secured to the base with a FIG. 8 clamp. The central part of the clamp serves to delineate two chambers. The clamp is preferably recessed so as not to extend above the general plane of the top surface of the base.

The base may have has one or more recesses located underneath the central part that provide fluid communication between the first and second chambers but other devices, such as internal or external bore or tubes or valves, may be used to communicate the chambers with each other.

The chambers may be sealed or one or more openings may be provided through which fluid may be selectively introduced into or removed from the chambers. This enables the user to modify the size of the chambers and characteristics of the device. The openings also allow fluid to be expelled from the chambers, so allowing the volume of both sets of chambers to be simultaneously reduced toward the minimum volume, such as when the device is stored or otherwise not used. In preferred embodiments the fluid is a gas and more preferably air. However, other gases may be used. Liquids may also be used.

The volume of the first and second chambers may be the same or different. More than one passageway may be provided between the chambers. The resistance to fluid flow between the chambers may be the same in both directions or it may be different.

The passageways may include flow restrictors to control fluid flow and the resistance to fluid flow.

Two or more passageways may be provided, split into two or more groups. One group may allow fluid flow from the first to the second chambers but not from the second to the first. Another group may allow fluid flow from the second chambers to the first but not from the first to the second. One-way valves in the passageways may be provided to achieve this. The passageways and/or valves may be configured to provide the same or different resistance to fluid flow. Alternatively, one group may allow fluid flow in both directions whilst another group may only allow fluid flow in a single direction. It will be appreciated that it is within the scope of the invention that the passageways may be configured to provide symmetrical or asymmetrical resistance to fluid flow as desired.

Where a single passageway is provided, symmetric or an asymmetric resistance to flow may be provided. This may be achieved by providing a suitable flow restrictor located in the passageway. An asymmetric flow restrictor is one in which fluid flow in one direction is less restricted than in the other direction.

In one embodiment of the invention the base is provided with first and second portions mounted to each other about a hinge line. The first portion may include one or more first chambers and the second portion may include one or more second chambers. Alternatively, both portions may each include first and second chambers.

In one preferred embodiment, pushing downwards with the ball of the user's foot reduces the volume of the first chambers whilst pushing downwards with the heel of the user's foot reduces the volume of the second chambers. As the volume of a set of chambers is reduced the volume of the other set of chambers is increased.

The chambers provided for each foot may be independent of the chambers provided for the other foot. However, in one embodiment valves are provided to selectively link the first chamber(s) provided for one foot with the first chambers provided for the other foot and to isolate the first chambers of one foot from the second chambers of that foot. The valve may also serve to connect the second chambers with each other. The valve may be configured so that first and second chambers are linked at the same time or so that only one set is connected at one time. Thus the valve may have four settings: normal, first chambers only, second chambers only and first and second chambers simultaneously.

BEST MODE OF CARRYING OUT THE INVENTION

Figure 1:
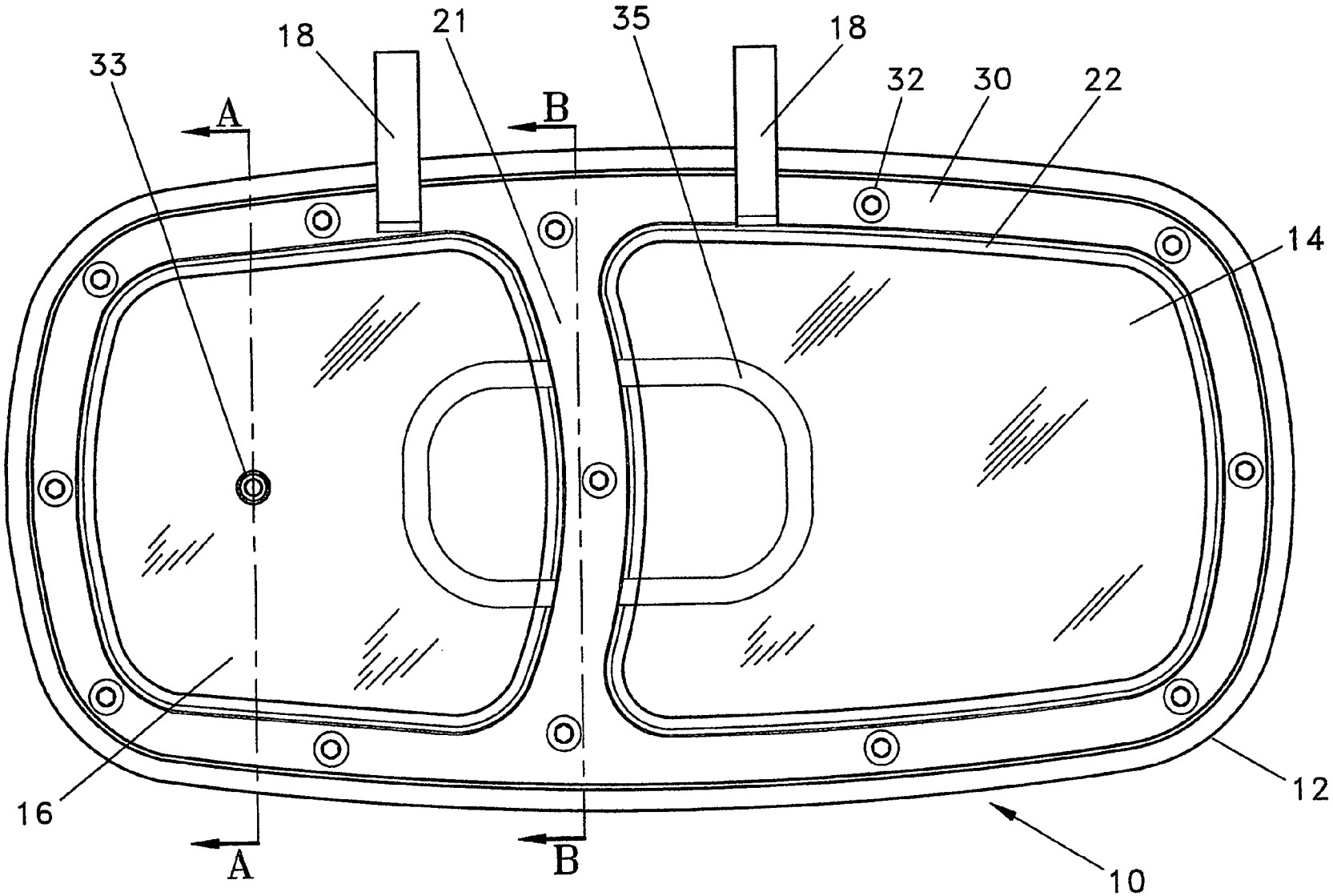
FIG. 1 is a top plan view of a first embodiment of the invention.
Figure 2:
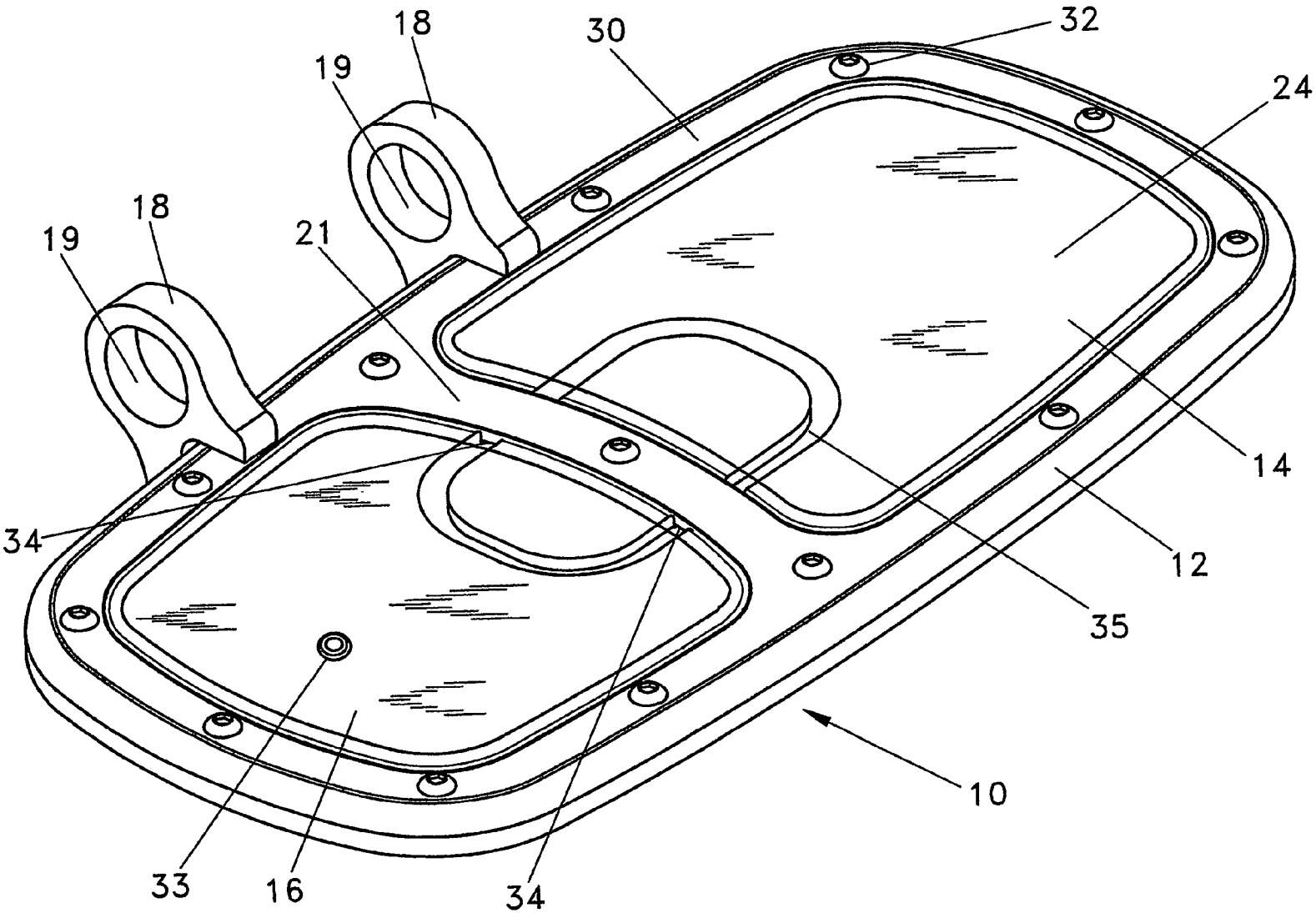
FIG. 2 is a perspective view from above of the first embodiment.
Figure 3:
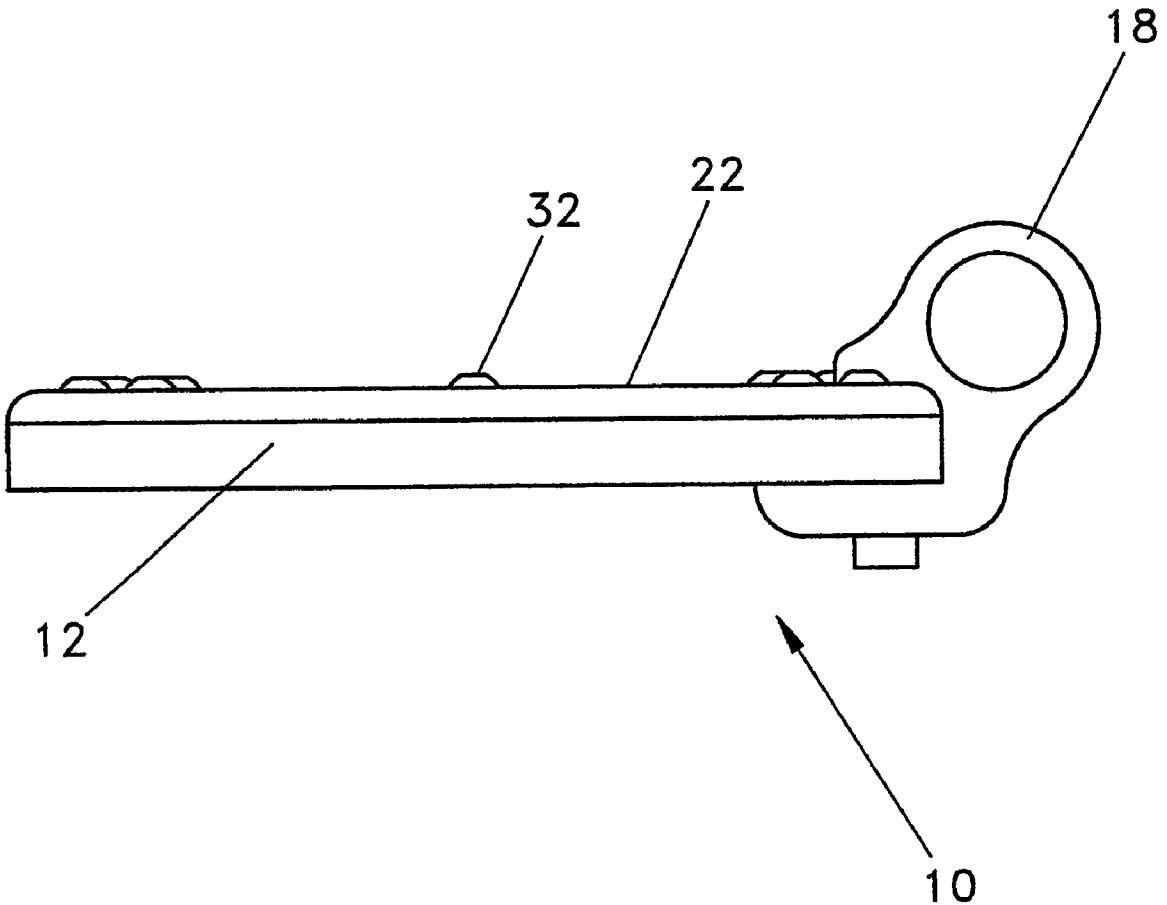
FIG. 3 is an end view of the first embodiment.
Figure 4:
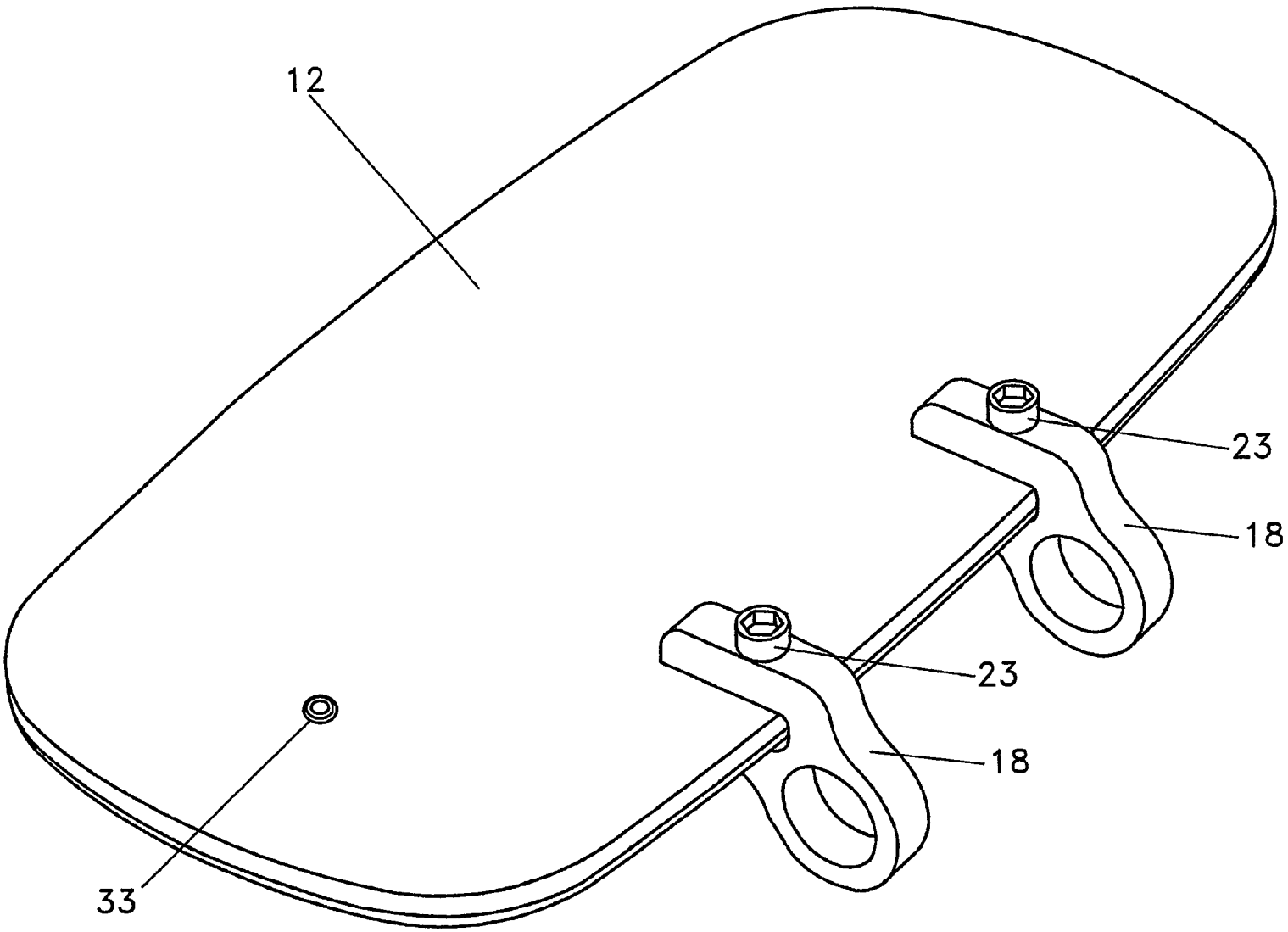
FIG. 4 is a perspective view from below of the first embodiment.
Figure 5:
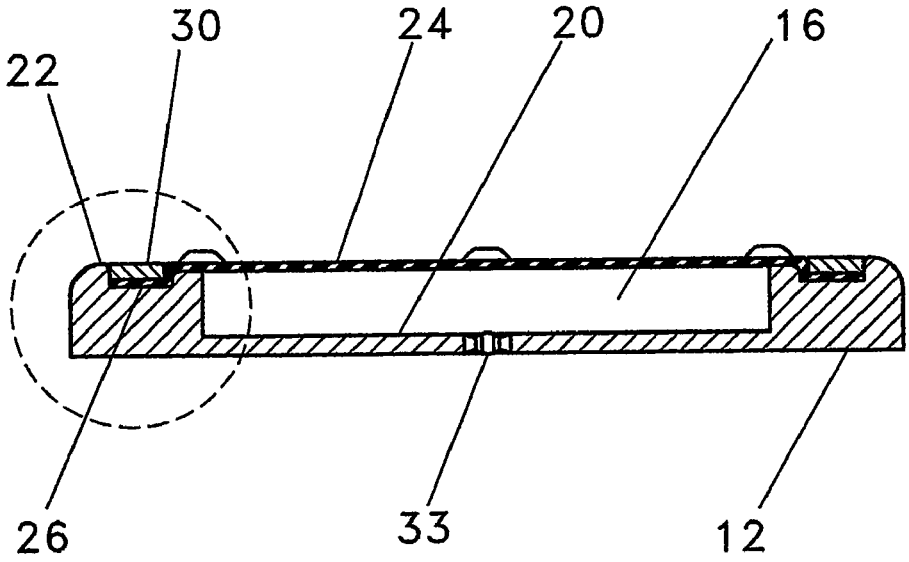
FIG. 5 is a cross-sectional view of the first embodiment taken along line AA in FIG. 1.
Figure 5:
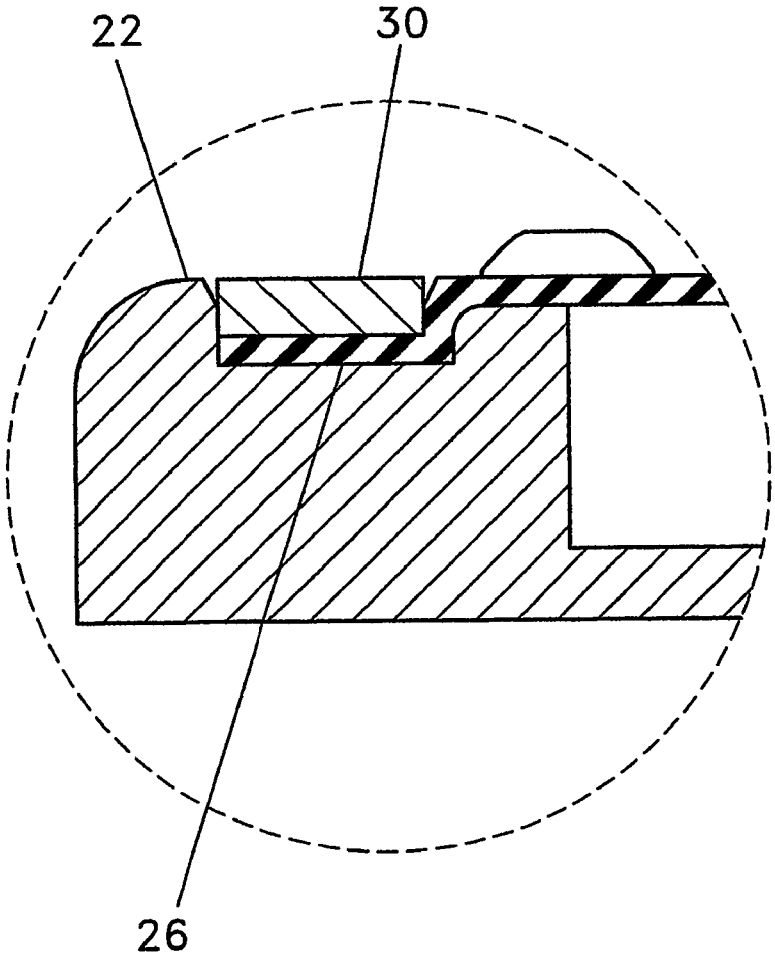
Figure 6:
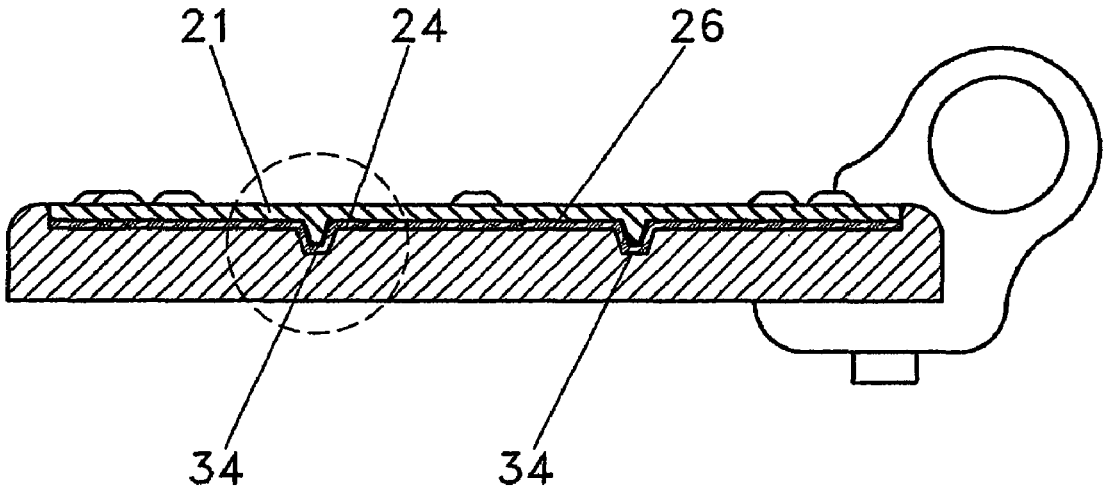
FIG. 6 is a cross-sectional view of the embodiment of FIG. 1 taken along line BB in FIG. 1
Figure 6:
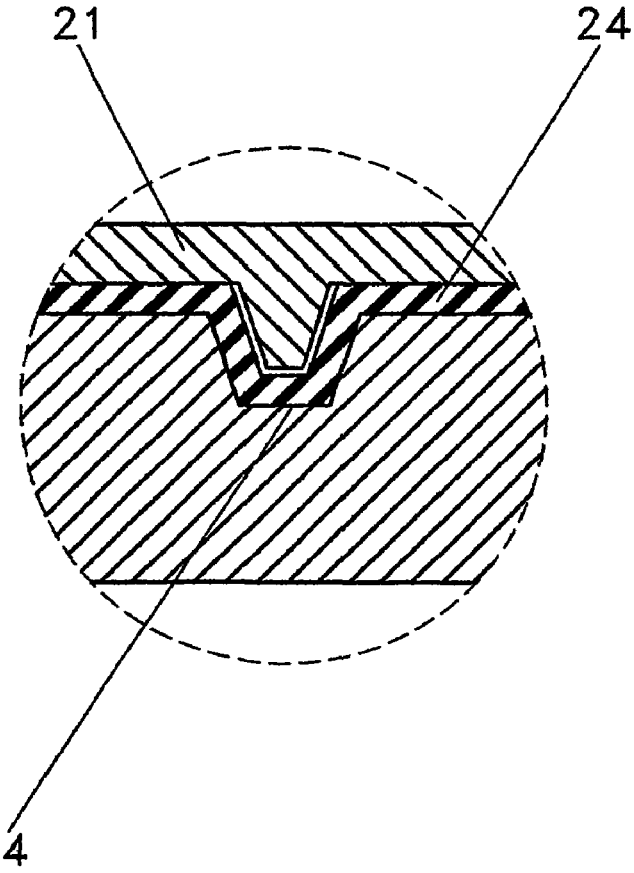
Figure 7:
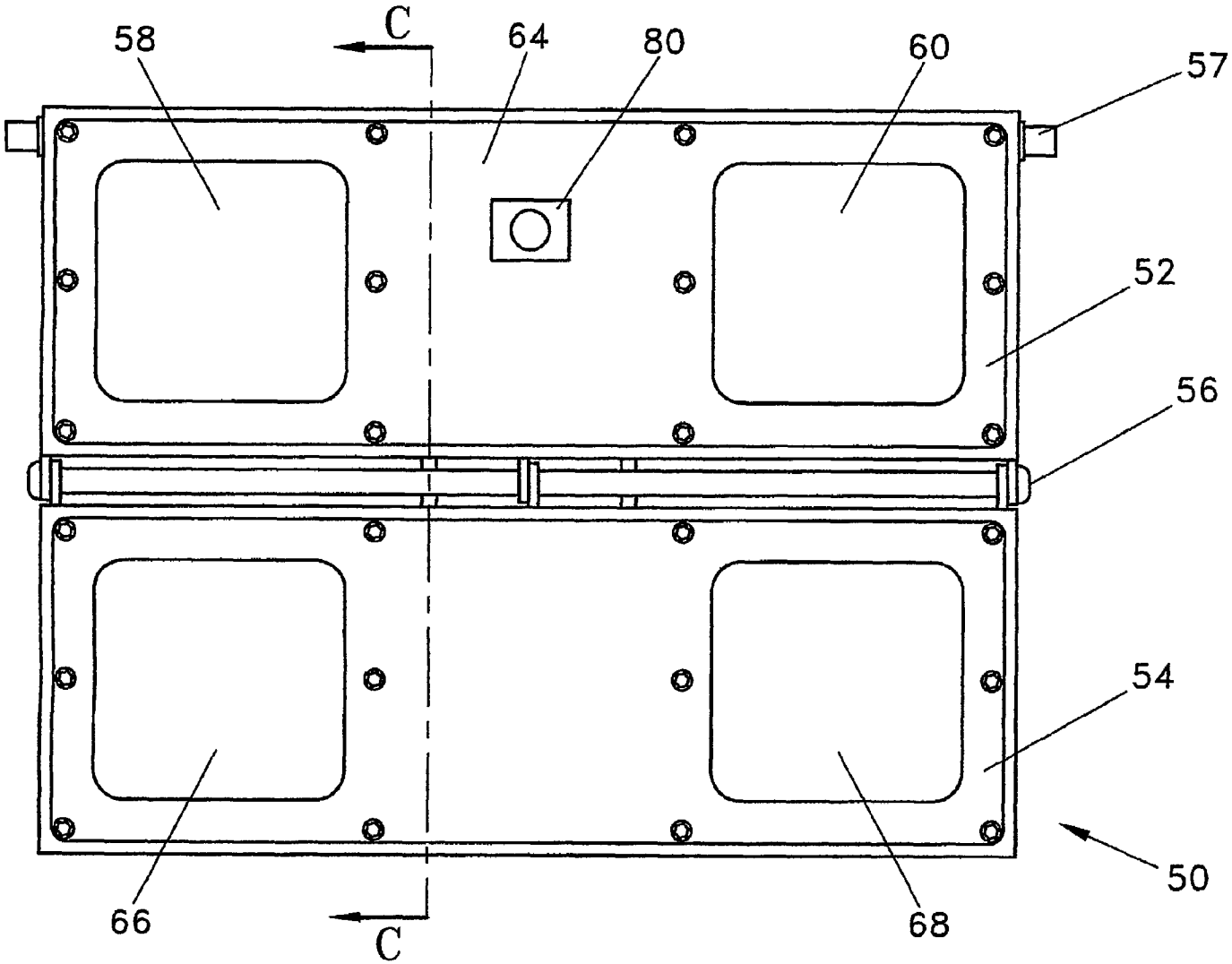
FIG. 7 is a plan view of a second embodiment of the invention in an open position.

Referring to FIGS. 1 to 6 there is shown a leg exercise device 10.

The device 10 has a base 12 and two chambers 14 and 16. The chambers 14 and 16 are each defined by the space between the top surface 22 of the base 12 and a flexible membrane 24 that extends over the top surface. The flexible membrane 24 is sealed to the top surface 22. The flexible membrane 24 is preferably a sheet of silicon type plastics. Other plastics, rubbers or any other suitable material may be utilised. Sheets comprised of multiple layers of materials may also be used.

Figure 8:
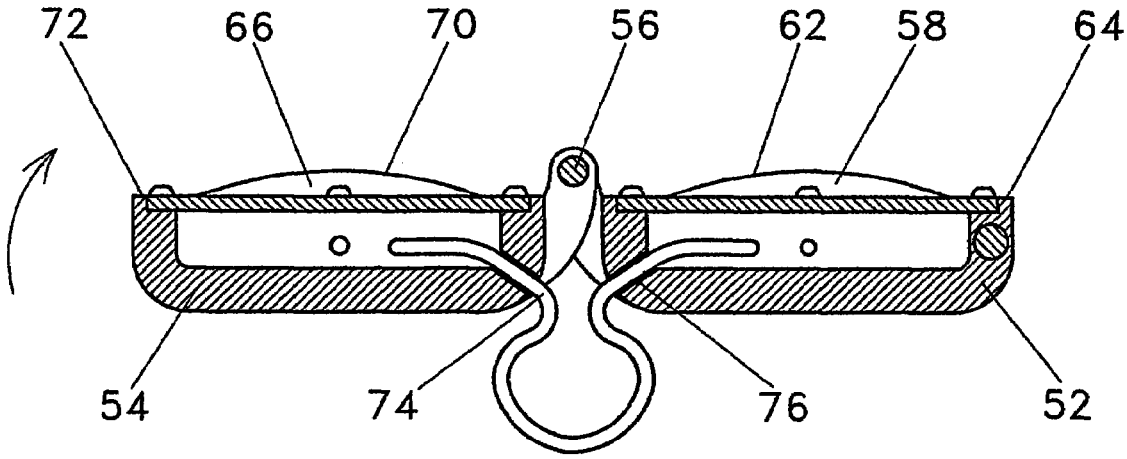
FIG. 8 is a cross-sectional view of the second embodiment, taken along line CC in FIG. 7.
Figure 9:
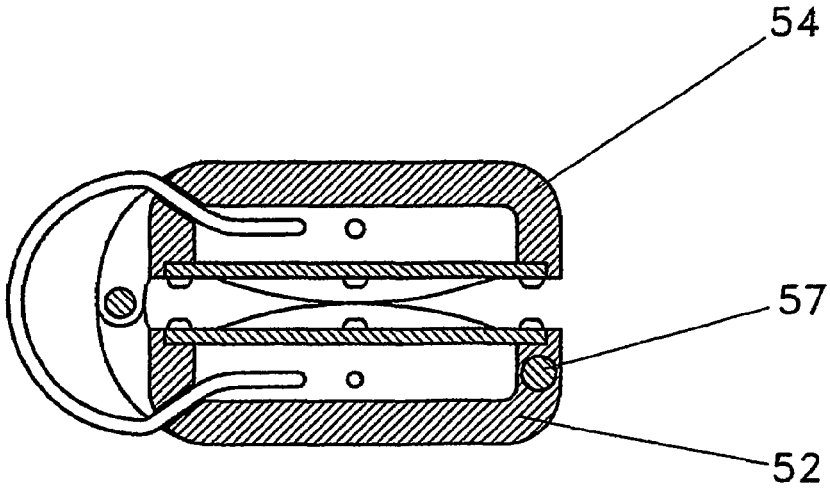
FIG. 9 is a cross-sectional view of the second of embodiment, taken along line CC in FIG. 7 but when in the closed position.

In this embodiment the top surface 22 is provided with a FIG. 8 recess 26. A clamping member 30 is located within the recess 26 and sandwiches the flexible membrane 24 between itself and the base member 12. The clamping member 30 is secured to the base member 12 by a series of fasteners 32 that extend through apertures in the clamping member 30 and the membrane 24 to engage the base 12. Preferably these fasteners are screw fasteners, allowing relatively easy assembly and maintenance of the device. Permanent fixings may be used instead. The flexible membrane 24 is substantially impervious to the fluid to be used in the chambers. When air is used and one or more inlets are provided to inflate the chambers, the membrane need not be absolutely impervious, so long as leakage occurs over a much greater time frame than each period of use. Thus leakage measured in days or weeks or longer will be acceptable. It will be appreciated that the base unit 12 must be similarly impervious.

The embodiment of FIG. 1 has a base formed of metal but other materials, such as plastics, polymer materials or fibre-reinforced composites may be utilised. The membrane 24 need not be secured to the base 12 utilising a separate clamping mechanism. The membrane may be secured utilising glue, adhesive or by welding the membrane to the base. Where glue or welding is utilised the base need not have a recess corresponding to recess 26. Instead the flexible membrane 24 may be secured to the top surface 22 of the base 12. Whilst a single membrane 24 is utilised for multiple chambers, it will be appreciated that separate membranes may be utilised for each chamber.

The chambers need not be partially defined by the base and instead may be fully formed of a flexible membrane, such as a bag that is supported on or in the base.

When the membrane(s) are clamped, a single clamping member may be utilised or separate clamping members may be utilised for each chamber. Obviously other mechanical fastenings may be used to secure the membrane(s) to the base. It will be appreciated that each clamping member 30 need not be a unitary component but may be formed of one or more individual pieces.

The base 12 is provided with an inlet valve 33 through which air or another fluid may be introduced into the chamber 16. This allows air to be selectively added or removed from the chambers. The valve may be of the type commonly used with car and bicycle tyres. Other valves may be used as desired. Although not shown, an integral hand or foot operated pump may be incorporated in the device so as to allow the user to easily pump up the chambers. The pump may be formed by providing a recess in the upper surface 22 of the base that is overlaid and sealed by the flexible membrane 24. Two one-way valves (one to allow air into the chamber and one to allow air out of the chamber) and a connection to the inlet 33 allow the user to pump air into the chambers 14 & 16 merely by repeatedly depressing the flexible membrane over the pump recess.

One of the chambers may have a captive grub screw or the like closing an opening, so that loosening of the grub screw allows air to be expelled from the chambers.

The chambers 14 and 16 communicate with each other via passageways 34 that extend under the central part 21 of the clamp 30. These passageways 34 are defined by recesses 35 in the upper surface of the base that pass under the central part 21 with the flexible membrane 24 clamped against the open mouth of the recesses 35 by part 21. The passageways are sufficiently small that there is significant resistance to air flow between the two chambers 14 and 16.

The recesses 35 extend in a U shape so that as the flexible membrane is pushed downwards air may still flow to the passageways 34. If desired the recesses may have a grid type arrangement extending over substantially the entire base surface of each chamber. If desired, a recess may be provided in the top surface for one or each chamber that extends under all of substantially all of the membrane, so as to provide a greater volume for each chamber and allow the membrane to be depressed into the recess.

The passageways 34 have no valve structure and the resistance to fluid flow is solely due to their size. The passageways need not be partially defined by the membrane but may be bores extending fully within the base 12 or external tubes. It will be appreciated that the device is not limited to having two passageways and that any number of passageways from one upwards may be provided. The number and size of the passageways will be determined with reference to the fluid used and the resistance desired.

One or more valve or flow restrictor mechanisms (not shown) may be provided to control fluid flow. The valves may be configured so that there is less resistance to fluid flow in one direction compared to fluid flow in the opposite direction. The valves may be user adjustable so that the user may adjust the resistance to fluid flow. The user may also vary the resistance by modifying the amount of air in the is chambers. More air may result in higher resistance.

Whilst the passageways extend between the two chambers via the central part 21, it will be appreciated that this is not critical and it is merely necessary that the two chambers be in fluid communication with each other.

The base is sized so that, in use, the heel of a user's foot rests on the flexible membrane 24 of the lower chamber 16 and the ball of the foot rests on the membrane of the upper chamber 14. By alternately pushing with the ball of the foot and then the heel of the foot the user pumps fluid between the two chambers and exercises the lower leg of the user. The flexible membrane depresses as fluid flows out of the chamber and rises as fluid flows into the chamber and so the foot moves about the ankle as this occurs.

The device 10 is intended to be used on a wheelchair or bed and preferably pivotally clips to the leg of a wheelchair or bed frame as desired. When mounted on a wheelchair, it is intended that there be two devices, one for each foot, that replace the footrests normally found on wheelchairs. Similarly two such devices may be mounted at the foot of a bed, such as on a movable panel. To allow this, the device includes two mountings 18 that are attached to the base by bolts 23 screwed into the rear surface of the base 12. These mountings include a central bore 19 to allow mounting on a tubular section of a bed or wheelchair. It will be appreciated that the mountings may be formed integrally with the base, may have different configurations and, if separate, may be attached to the base by other types of fastenings.

It will be appreciated that, in use, a pair of chambers will be provided for each foot. A single base unit may be provided with two sets of chambers, one set for each foot. Alternatively, two units as per FIGS. 1 to 3 may be provided, one for each foot.

FIGS. 7 to 11 show a second embodiment of the invention intended for use in public transport vehicle, such as airplanes, trains and long haul coaches. The device 50 is intended as a replacement for the footrests commonly found in these vehicles. The device 50 comprises an upper base unit 52 and a lower base unit 54 connected to each other about a hinge 56. The two base units 52, 54 are rotatable between an open position (FIGS. 7 and 8) in which they lie generally in a plane and a closed position in which the lower base unit lies on top of the upper base unit (FIG. 9) at approximately 180° to the open position. The upper base unit 52 is provided with mountings 57 by which it may be mounted to a seat in front of the seat of the user. The mounting 57 preferably allows the upper base unit 52, together with the lower base unit 54, to be pivoted out of the way when desired.

The two base units are sized so that a user may place their two feet side by side on the device with the heels of the feet resting on the lower base unit and the balls of the feet on the upper base unit.

Located on the upper surface of the upper base unit 52 are two upper chambers 58 and 60. As with the first embodiment these chambers are partially defined by a flexible membrane 62 that, in use, extends above the general plane of the upper surface 64 of the upper base unit 52.

The lower base unit 54 is similar to the upper base unit 52 and is provided with lower chambers 66 and 68. These chambers are also partially defined by flexible membranes 70 that, in use, extend above the general plane of the upper surface 72 of the lower base unit 54.

The upper and lower chambers 58, 60, 66, 68 communicate with each other via tubes 74 that connect to the rear of the base units 52, 54 and communicate with the chambers via passageways 76 extending through the respective base unit to open within the chambers.

The tubes extend to a valve unit 80 positioned on the upper base unit 52. The valve unit 80 controls how the chambers communicate with each other.

Figure 10:
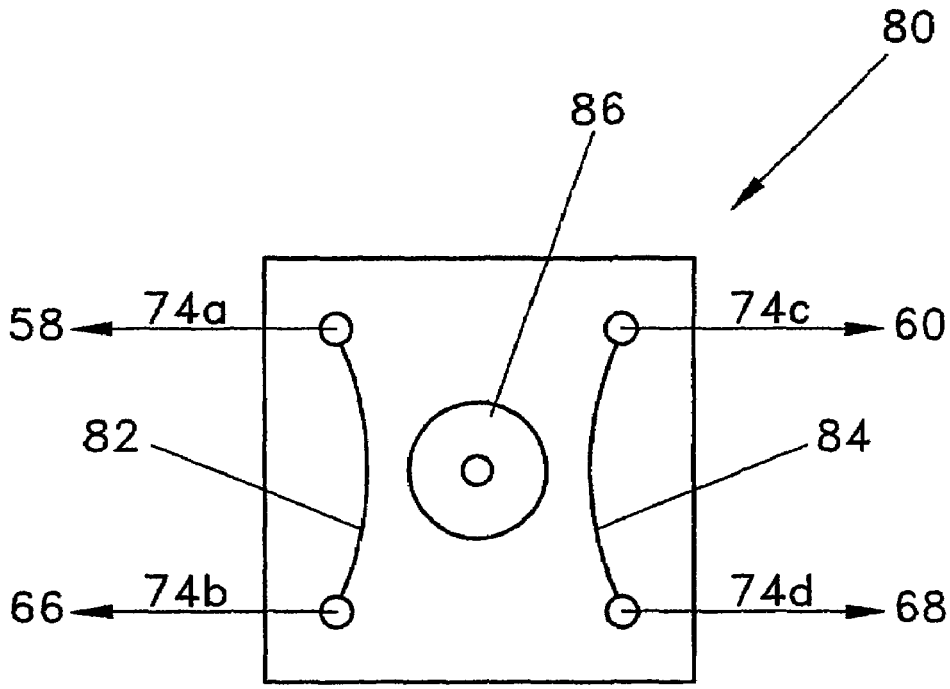
FIG. 10 schematically shows one configuration of the valve and linking of the chambers of the second embodiment of the invention.
Figure 11:
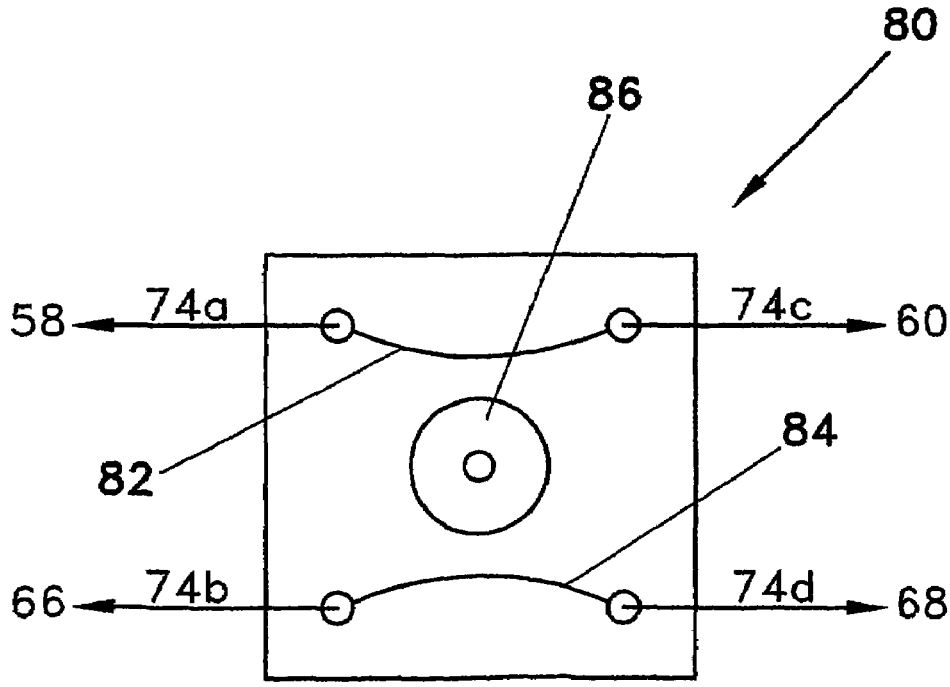
FIG. 11 schematically shows a second configuration of the valve and linking of the chambers of the second embodiment of the invention.

Referring to FIG. 10, the valve 80 is in a first position in which the left hand chambers communicate with each other and the right hand chambers communicate with each other. The tubes 74*a* and 74*b* from chambers 58 and 66 communicate via valve passageway 82 whilst tubes 74*c* and 74*d* communicate via valve passageway 84.

The valve 80 may be changed to a second position (FIG. 11) in which the upper chambers communicate with each other via passageway 82 and the lower chambers communicate with each other via passageway 84. This is achieved merely by rotating the valve mechanism 90 degrees using control knob 86. It will be appreciated that each 90° rotation in either direction changes the connections between the two configurations.

When the left hand chambers are connected together and the right hand chambers the device operates in a heel and toe manner, with each foot/leg moving independently of each other.

Figure 12:
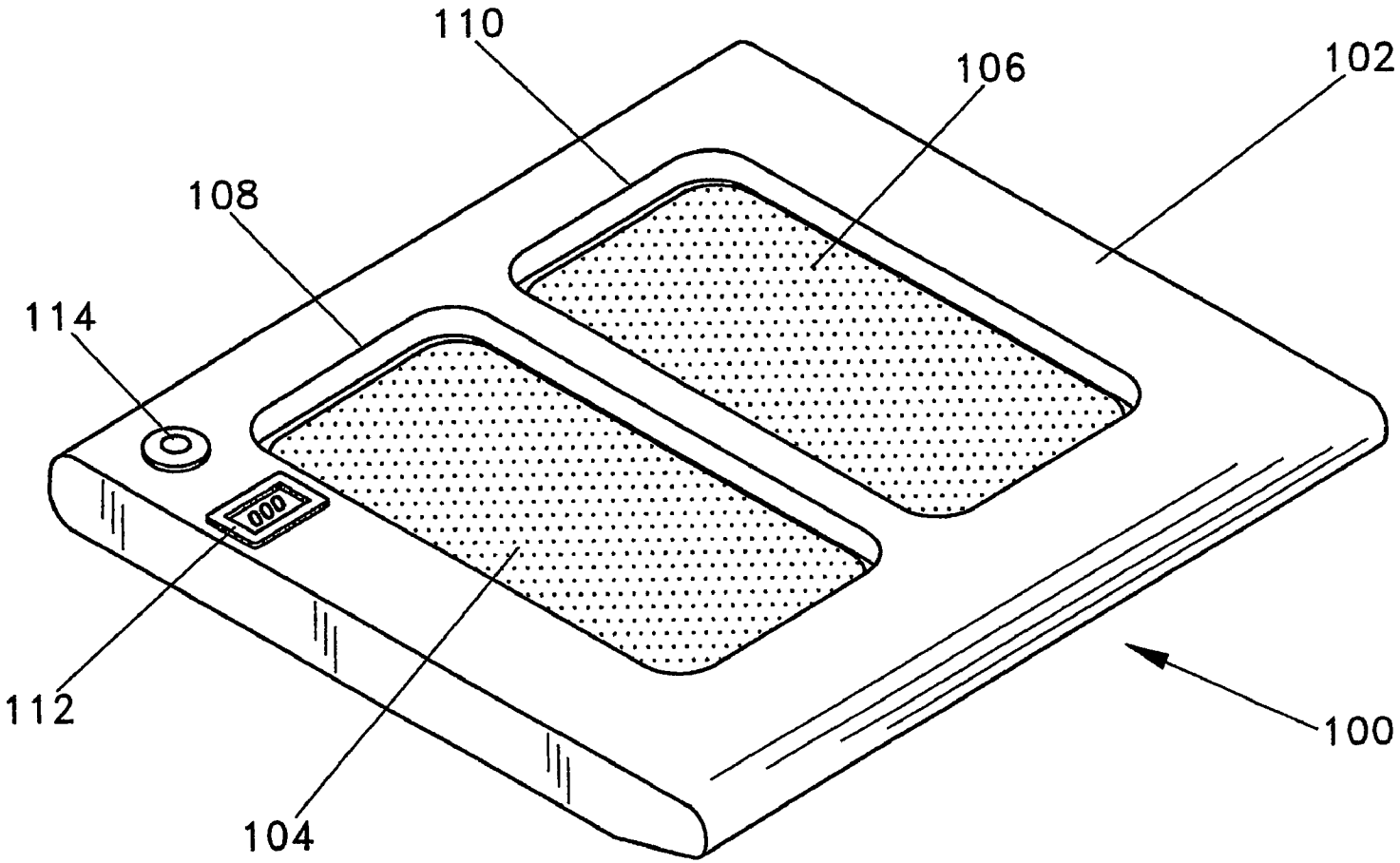
FIG. 12 shows a perspective view of a third embodiment of the invention.

When the upper and lower chambers communicate with each other the device has a leg pumping action, where one leg rises whilst the other falls. FIG. 12 shows a leg exercise device 100 having a shell 102 and two chambers 104 and 106 located within the shell 102. A top surface of each chamber 104, 106 is accessible to the user via apertures 108 and 110 in the shell. The chambers 104 and 106 are air filled bags that communicate with each other via tubes and/or passageways (not shown). An inlet valve (not shown) allows the chambers to be inflated with air. The chambers are located side by side and are sized so that a user may place a left foot in the left hand aperture 108 onto the top of the left hand chamber 104 and a right foot in the right hand aperture 110 onto the top of the right hand chamber 106.

The passageway(s) that allow air to flow between the two chambers 104 and 106 include a sensor (not shown) that detects cycling of the air between the two chambers. This may be a pressure sensor or an airflow sensor or any other suitable sensor. The sensor is connected to a display unit 112 that displays a count of the number of cycles performed by the user. The display may be a count up or a count down display or may be set to either by the user. The device also includes a timer and a warning light 114, preferably a light emitting diode type light, which flashes after predetermined periods on no use, so as to remind the user that it is time to use the device again. The time period may be fixed or may be user selectable.

While this invention has been particularly shown and described with reference to a preferred embodiments thereof, it will be understood by those skilled in the art that various changes in form and details may be made therein without departing from the spirit and scope of the invention as described herein.

INDUSTRIAL APPLICABILITY

The invention has application in providing a foot and/or leg-exercising device.

The invention claimed is:

1. A leg exercise device having:

a rigid base;

two first separately sealed variable volume chambers mounted on or partially defined by the base;

two second separately sealed variable volume chambers mounted on or partially defined by the base;

a volume of fluid less than the combined maximum volume of the first and second chambers being located in each pair of first and second chambers;

two first surfaces, each sized and located to receive a respective first part of each of a user's feet and convey compressive force between the first part and a respective first chamber, and two second surfaces, each sized and located to receive a respective second part of each of a user's feet and convey compressive force between the second part and a respective second chamber, and a valve;

at least one passageway interconnecting each of said chambers with said valve;

said valve having first and second states, wherein:

when in the first state the valve isolates first chambers from second chambers and links, via respective passageways, the first chamber provided for one foot with the first chamber provided for the other foot and links, via respective passageways, the second chamber provided for one foot with the second chamber provided for the other foot, and when in the second state the valve isolates chambers of one foot from the chambers of the other foot and links, via respective passageways, the first chamber provided for one foot with the second chamber provided for the one foot and, via respective passageways, links the first chamber provided for other foot with the second chamber provided for the other foot.

2. The device of claim 1 wherein each of said first surfaces includes at least part of the respective first chamber.

3. The device of claim 1 wherein each of said second surfaces includes at least part of the respective second chamber.

4. The device of claim 1 wherein at least part of one of the first and second chambers is defined by a flexible wall or membrane.

5. The device of claim 4 wherein the flexible wall membrane is formed of an elastic material.

6. The device of claim 4 wherein the flexible membrane is formed of a substantially inelastic material.

7. The device of claim 1 further including at least one flexible membrane attached to the base, the base and at least part of the at least one flexible membrane defining at least one first chamber.

8. The device of claim 7 wherein the at least one flexible membrane defines at least one first chamber and at least one second chamber.

9. The device of claim 7 wherein the base has a recess for each chamber.

10. The device of claim 7 wherein the base has a substantially non-recessed surface on which the flexible membrane is mounted.

11. The device of claim 7 wherein the flexible membrane is secured to the base with at least one clamp.

12. The device of claim 7 wherein the at least one passageway includes at least one recesses in a surface of the base.

13. The device of claim 1 wherein the at least one passageway includes at least one external tube communicating one chamber with said valve.

14. The device of claim 1 wherein the base includes first and second portions mounted to each other about a hinge line.

15. The device of claim 14 wherein said first and second portions each include one first and one second chamber.

16. The device of claim 1 including at least one opening to at least one chamber through which fluid may be selectively introduced into or removed from the chamber.

17. The device of claim 1 wherein the resistance to fluid flow between the first and second chambers is the same in both directions.

18. The device of claim 1 including at least one mounting for attachment of the device to another object.

19. The device of claim 1 wherein the base comprises a footrest for one or two of a user's feet.

* * * * *